United States Patent [19]

Carpenter, Jr. et al.

[11] 4,003,164

[45] Jan. 18, 1977

[54] WORKPIECE TREATING BARREL

[75] Inventors: James H. Carpenter, Jr.; Charles H. Bradley; Bernard W. Ixer, all of Hagerstown, Md.

[73] Assignee: The Carborundum Company, Niagara Falls, N.Y.

[22] Filed: Apr. 22, 1974

[21] Appl. No.: 463,073

[52] U.S. Cl. ..... 51/13; 241/183

[51] Int. Cl.[2] ..... B02C 17/02; B24C 3/26

[58] Field of Search ..... 51/13, 164; 241/91, 241/179, 181–183, 278 R, 284

[56] References Cited

UNITED STATES PATENTS

| | | | |
|---|---|---|---|
| 945,174 | 1/1910 | Larson | 241/91 UX |
| 1,309,212 | 7/1919 | Marcy | 241/181 X |
| 2,670,140 | 2/1954 | Douglas | 241/183 X |
| 2,684,206 | 7/1954 | Zettel | 241/183 X |
| 2,942,731 | 6/1960 | Soldini | 241/91 UX |
| 3,194,506 | 7/1965 | Bourne | 241/182 X |
| 3,378,209 | 4/1968 | Crocheron | 241/182 X |
| 3,693,296 | 9/1972 | Carpenter | 51/13 |

*Primary Examiner*—Gary L. Smith
*Attorney, Agent, or Firm*—David E. Dougherty; William H. Holt

[57] ABSTRACT

A barrel for use in treating workpieces, such as cleaning, scouring, deburring, etc., with abrasive blasting particles, high pressure fluid jets, etc. The barrel is intended to be rotated and includes a novel spiral flight which pushed workpieces through the barrel, a novel arrangement of drain holes for voiding the barrel of debris such as blast particles, flashings, cleaning fluid, etc., and includes novel turning cleats which cause workpieces to turn over within the barrel to expose various portions thereof to a blast stream of particles or fluid.

18 Claims, 8 Drawing Figures

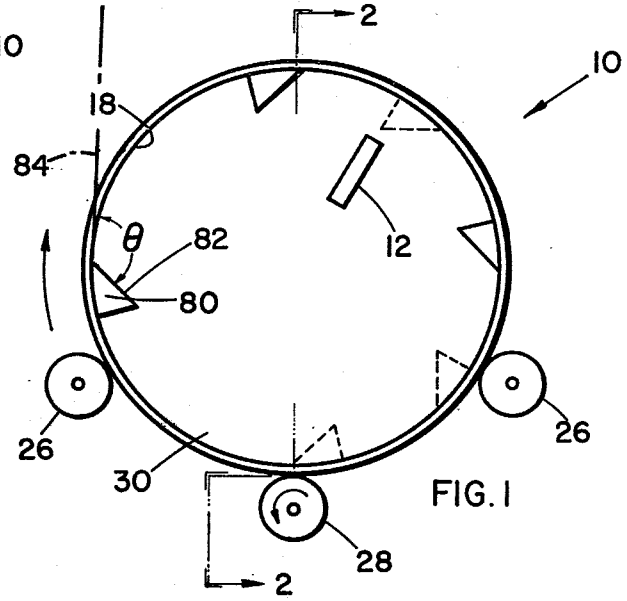
FIG. 1
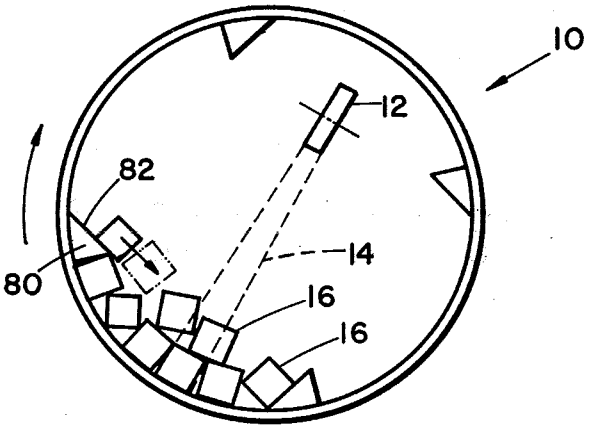
FIG. 8
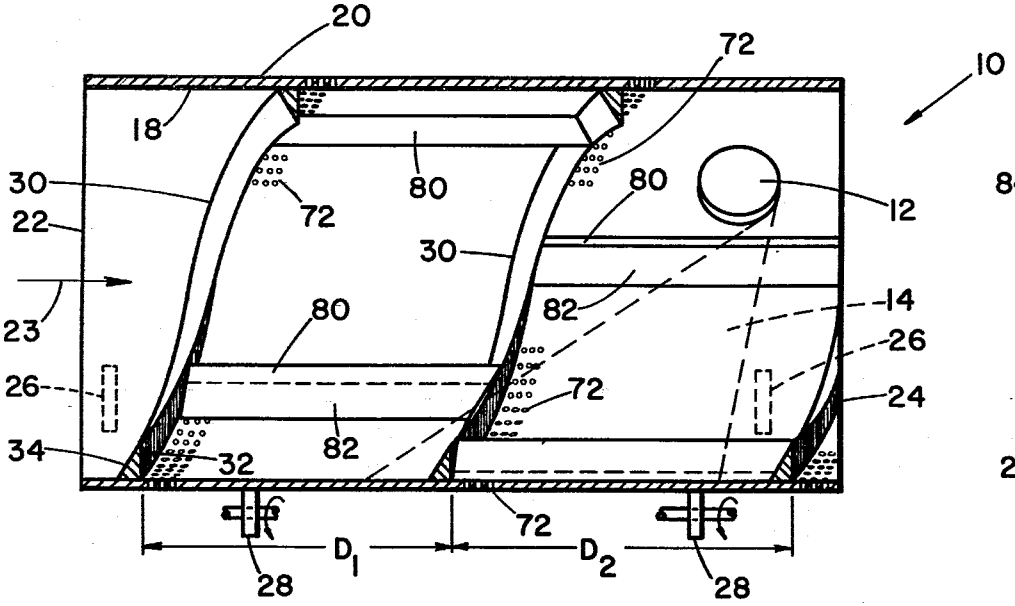
FIG. 2
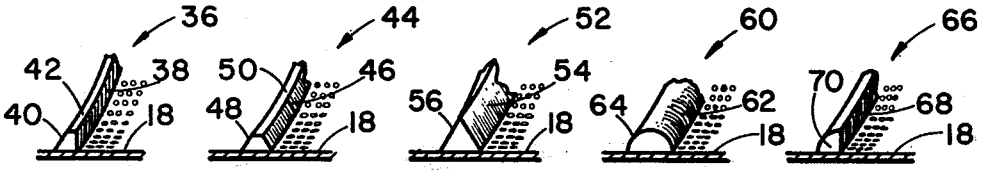
FIG. 7
FIG. 6
FIG. 5
FIG. 4
FIG. 3

WORKPIECE TREATING BARREL

BACKGROUND OF THE INVENTION

Typical embodiments of known types of workpiece treating barrels are disclosed in U.S. Pat. Nos. 3,693,296 and 3,782,643, both patents being presently owned by the assignee of the present invention.

Barrels exemplified by the prior art, while generally satisfactory in operation, must be used with caution in order to minimize breakage of workpieces being treated therein. Certain types of workpieces, such as automobile crank shafts, automobile manifolds, and other types of relatively fragile castings tumble within the barrel, tend to ride up the barrel and fall back upon other workpieces, and also to hang-up on the workpiece pushing flights so as to be carried up high within the barrel and then fall with consequent breakage of parts.

SUMMARY OF THE INVENTION

The present invention relates to an improved workpiece treating barrel designed to overcome short comings of previously known devices with the results of eliminating or minimizing breakage of parts and providing a barrel which is usable with a larger variety of workpieces than has been heretofore possible.

It is an object of the invention to provide an improved workpiece pushing means which comprises a spiral flight which engages and forces workpieces along the drum during rotation of the barrel. Various embodiments of such flights are contemplated, each of which has desirable features for varying types of workpieces, and all of the embodiments have the common feature of including a trailing face portion which allows workpieces to ride-up thereover to forestall jamming or hang-up of workpieces as they are forced along the barrel by other workpieces moving there through.

A further object of the invention is to provide a very substantial reduction in the fabricating and manufacturing costs of such treating barrels by providing a unique arrangement of drain holes for allowing escape of debris, flashing, abrasive particles and/or fluid cleaning media from within the barrel during treatment operations.

A still further object of the invention is to provide an improved cleat design for causing workpieces to turn or rotate within the barrel, thus exposing various surfaces to the blast pattern, while substantially reducing or eliminating breakage of parts as compared to prior art devices.

REFERENCE TO DRAWINGS

FIG. 1 is an end view of a workpiece treating barrel embodying the present invention.

FIG. 2 is a vertical section, taken on line 2—2 of FIG. 1.

FIGS. 3–7, inclusive, show fragmentary portions of different embodiments of spirally disposed workpiece pushing means.

FIG. 8 is a vertical section, similar to the end view of FIG. 1, and illustrates the releasing or non-locking feature of the unique workpiece turning cleats.

DESCRIPTION OF THE PREFERRED EMBODIMENTS

A workpiece treating barrel, generally indicated by the numeral 10, is provided for moving workpieces, e.g.

various types of castings such as automobile crank shafts, heads, blocks, etc., past a conventional throwing wheel 12 or other types of blasting or cleaning equipment such as high pressure water jets which may or may not contain abrasive particles and the like. This type of blasting or cleaning equipment is well known in the foundry art and is particularly useful for scouring or cleaning foundry sand from castings and for deburring flash lines and the like from molded or cast articles. A typical spray or blast pattern 14 is directed at workpieces 16, as best shown in FIG. 8, for performing the desired cleaning or deburring treatment.

Typically, the barrel 10 is constructed of wear resistant material, such as manganese steel, so that it can withstand the impact of abrasive particles and the like. Barrel 10 is generally tubular, usually cylindrical, and includes an inner wall 18 and an outer wall 20 to define a hollow interior having a first open end 22 for passing or admitting workpieces into the barrel, in the direction indicated by the arrow 23, and an open second end 24 for passing workpieces out of the barrel after the treatment has been completed. Various types of drive means may be utilized for rotating the barrel 10 about its longitudinal axis, a typical arrangement being illustrated as including a series of guide rollers 26 and a plurality of drive rollers 28 suitably connected to a drive motor (not shown).

During operation, workpieces are introduced into the barrel 10 at its first open end 22 and, as the barrel 10 is rotated by the drive rollers 28, the workpieces are gradually put through the barrel and past the blast pattern 14 by workpiece pushing means which are comprised of a spiral flight 30 which is affixed to and extends along the inner wall 18 and, preferably, the spiral flight 30 defines an expanding helix which increases in pitch toward the open second end 24 such that, as is shown in FIG. 2, the distance $D_1$ is smaller than the distance $D_2$. This expanding helical shape is desirable in order to preclude or minimize workpieces from being jammed between adjacent spirals and being carried to the top of the barrel 10 and subsequently falling to the bottom of the barrel and causing breakage. The pushing means or spiral flight is, desirably, particularly designed with attention being given to the type and shape of workpiece which is to be treated. Spiral flight 30, as is shown in FIG. 2, is particularly useful in connection with automobile heads and crank shafts. Flight 30, in a section normal to the inner wall 18 and longitudinally of the barrel 10, defines a right triangle which includes a leading face portion 32 disposed normal to the inner wall 18 on the side of flight 30 facing toward open end 24. In this form of the invention, the leading face portion 32 engages the workpiece and moves it forwardly during rotation of the barrel 10. Spiral flight 30 also includes a trailing face portion 34 disposed on a side thereof facing toward the open first end 22. It is an important part of the present invention that the trailing face portion 34 is sloped or inclined in a direction toward the open second end 24 so that, during rotation of the barrel 10, workpieces which are forced against the trailing face portion 34 by other workpieces being tumbled within the barrel can ride up over the spiral flight 30 and not become jammed or hung up between the spirals and be carried upwardly during rotation.

FIGS. 3–7, inclusive, illustrate various embodiments of workpiece pushing means which are usable in lieu of spiral flights 30 for workpieces having different sizes and shapes.

As is shown in FIG. 3, a flight 36 defines a right trapezoid, in a section normal to the inner wall 18 in a plane longitudinal of the barrel 10, and includes a pushing surface or leading face portion 38 disposed normal to the inner wall 18, and a sloping or inclined trailing face portion 40. A top face portion 42 is comprised of a flat area having a width larger than the distance between the throws on a crank shaft and is therefore particularly useful to present locking of crank shafts upon the spiral flight.

FIG. 4 shows a different embodiment of a spiral flight 44 which, in a plane normal to the inner wall 18 and longitudinal of the barrel 10, is an isosceles trapezoid having a reversely inclined leading face portion 46, a forwardly sloped or inclined trailing face portion 48 and a flat top face portion 50. Flight 44 is useful for crank shafts much in the same manner as flight 36 except that flight 44 includes the rearwardly inclined leading face portion 46 which aids in preventing wedging of workpieces between adjacent spirals of the flight.

FIG. 5 shows another embodiment of spiral flight 52 which, in a plane normal to inner wall 18 and longitudinal of barrel 10, defines an isosceles triangle having a rearwardly sloped or inclined leading face portion 54 and a forwardly sloped or inclined trailing face portion 56. Flight 52 may, like spiral flight 30, be used for handling heads or blocks with the added feature of rearwardly sloped face portion 54 to minimize wedging between adjacent spirals of the flights.

FIG. 6 shows another embodiment of a workpiece pushing means wherein a spiral flight 60 defines, in a plane normal to inner wall 18 and longitudinal of barrel 10, an arcuate section which includes a curved leading face portion 62 and a forwardly inclined trailing face portion 64. More particularly, flight 60 defines, in section, a semi-circle and is useful for crank shafts in that the throws will not hang up upon the arcuate surface.

FIG. 7 shows a further embodiment of workpiece pushing means comprising a spiral flight 66 which is similar to flight 60 except being in the form of a quadrant of a circle and includes a leading face portion 68 and a forwardly inclined or sloped trailing face portion 70. Spiral flight 66 is more useful than spiral flight 60 for small workpieces because of the leading face portion 68 being disposed normal to the inner wall 18 to minimize the possibility of small workpieces riding up over the leading face portion 68 and remaining within the barrel 10 during the treatment operation. In this regard, it is to be appreciated that abrasive particles or liquid jets forming the blast pattern 14 act to move workpieces toward the open end 22 in opposition to the action of the spiral flight which moves the workpieces toward the open end 24.

Another important feature of the novel barrel 10 relates to the provision of a series of drain holes 72 for allowing escape of blasting media such as abrasive particles or liquid, foundry sand, bits of flashing, etc. It is to be understood that such drain holes are expensive to drill or punch in the wear resistant material of which the barrel 10 is constructed, e.g. manganese steel. Heretofore, prior art barrels were provided with drain holes equally spaced throughout the full extent of the barrel 10 and extending between the inner wall 18 and the outer wall 20. The drain holes 72, as contemplated by the present invention, consist essentially of a narrow band of drain holes which extend along the length of the barrel 10 and, more particularly, define a spiral extending along the inner wall 18 just forward of the leading face portion 32 of spiral flight 30, and similarly for the spiral flights illustrated in FIGS. 3–7, inclusive. This narrow band configuraton assures that abrasive particles and debris falling at any point on the barrel 10 will be exposed to drain holes 72 during each revolution of the barrel; if the particles should miss the spiral band, such particles will be picked up by the spiral flights and held along the length of the flights until the particles eventually fall through a drain hole.

Another important feature of the invention is that workpiece treating barrel 10 is provided with a plurality of cleats 80 which are fixed along the inner wall 18 for engaging workpieces and causing them to tumble or turn over, during rotation of barrel 10, for causing the workpieces to have various surfaces thereof exposed to the blast pattern 14. The cleats 80 include a workpiece engaging face 82 which extends inwardly of the barrel 10 and is sloped or inclined rearwardly with respect to the direction of rotation of the barrel. A plurality of such cleats 80, the particular number being variable depending upon dimensions of particular workpieces, are disposed so as to extend longitudinally of the barrel 10 between adjacent spirals of the workpiece pushing flights 30. As is shown in FIG. 1, the workpiece engaging face 82 and a line 84, which is tangent to the inner wall 18, define an angle $\theta$, the angle being variable but being such that workpieces 16, as is illustrated in FIG. 8, are carried upwardly during rotation of the barrel 10 and slide off of the cleat 80 and tumble downwardly to expose different areas of the workpiece to the abrading or cleaning action of the blast pattern 14. Heretofore, cleats in accordance with the prior art would cause the workpieces to travel too far up the barrel with subsequent breakage during the tumbling action. Generally speaking, the workpieces 16 are carried up to a point approximately 90° from the vertical and they slide off of the workpiece engaging face. The angle $\theta$ is shown in FIG. 1 as being approximately 135°, this angle being exemplary and the angle may vary considerably, generally 20° or more, a suitable range being between 115° and 155°.

In summary, the spiral flights, as exemplified by spiral flight 30, the narrow band of spirally disposed drain holes 72 and the turning cleats 80 all cooperate to provide a workpiece treating barrel 10 which is a vast improvement over previously known treating barrels. The spiral flight 30 cooperates with the drain holes 72 to prevent build up of blasting media and debris while the workpiece turning cleats 80 and spiral flight 30 cooperate to move the workpieces into various positions beneath the blast pattern 14 in a manner which substantially reduces breakage of parts as compared to the prior art.

It is to be understood that the foregoing description of preferred embodiments are illustrative of the invention but various modifications and changes may be made within the scope of the invention as defined in the claimed subject matter.

We claim:

1. An abrasive blast-resistant barrel for use in blast treatment of workpieces such as metal castings and the like; said blast-resistant barrel being constructed of a wear resistant material for withstanding the impact of abrasive particles and the like incident to a blast treatment of said workpieces and being generally tubular and including an inner wall and an outer wall; said barrel having a hollow interior, an open first end for passing a series of workpieces into said barrel and an open second end for passing workpieces out of said barrel; workpiece pushing means constructed of a wear-resistant material for withstanding the impact of abrasive particles and the like disposed on said inner wall for pushing each of said workpieces along the length of said barrel from adjacent said first end toward and out of said second end; said workpiece pushing means including a leading face portion on a side thereof disposed toward said open second end for engaging workpieces and pushing said workpieces toward said open second end and a trailing face portion on a side thereof disposed toward said open first end; the improvement comprising said trailing face portion being inclined in a direction toward said open second end for allowing workpieces to move upwardly and over said trailing face portion toward said open second end.

2. An abrasive blast-resistant barrel as defined in claim 1 wherein said workpiece pushing means forms a spiral flight extending along said inner wall.

3. An abrasive blast-resistant barrel as defined in claim 2 wherein said spiral flight defines an expanding helix gradually increasing in pitch toward said open second end.

4. An abrasive blast-resistant barrel as defined in claim 1 wherein said workpiece pushing means, in a section normal to said inner wall, defines a triangular section.

5. An abrasive blast-resistant barrel as defined in claim 4 wherein said triangular section defines a right triangle, and said leading face portion being disposed normal to said inner wall.

6. An abrasive blast-resistant barrel as defined in claim 4 wherein said triangular section defines an isosceles triangle.

7. An abrasive blast-resistant barrel as defined in claim 1 wherein said workpiece pushing means, in a section normal to said inner wall, defines a trapezoidal section.

8. An abrasive blast-resistant barrel as defined in claim 7 wherein said trapezoidal section defines a right trapezoid, and said leading face portion being disposed normal to said inner wall.

9. An abrasive blast-resistant barrel as defined in claim 7 wherein said trapezoidal section defines an isosceles trapezoid.

10. An abrasive-resistant barrel as defined in claim 1 wherein said workpiece pushing means, in a section normal to said inner wall, defines an arcuate section.

11. An abrasive blast-resistant barrel as defined in claim 10 wherein said arcuate section defines a semicircle.

12. An abrasive blast-resistant barrel as defined in claim 10 wherein said arcuate section defines a quadrant of a circle, and said leading face portion being disposed normal to said inner wall.

13. An abrasive blast-resistant barrel as defined in claim 1 further including drain means formed in said barrel and consisting essentially of a narrow band of drain holes extending along the length of said barrel; and cleat means on said inner wall for engaging and turning workpieces during rotation of said barrel.

14. An abrasive blast-resistant barrel as defined in claim 13 wherein said workpiece pushing means defines a spiral flight extending along said inner wall, said narrow band of drain holes defines a spiral extending along said inner wall adjacent said leading face portion of said workpiece engaging means, and said cleat means is of a length sufficient to extend substantially completely between adjacent spirals of said spiral flight.

15. An abrasive blast-resistant barrel for use in blast treatment of workpieces such as metal castings and the like; said blast-resistant barrel being constructed of a wear resistant material for withstanding the impact of abrasive particles and the like incident to a blast treatment of said workpieces and being generally tubular and including an inner wall and an outer wall; said barrel having a hollow interior, an open first end for passing a series of workpieces into said barrel and an open second end for passing each of said workpieces out of said barrel; and cleat means constructed of a wear resistant material for withstanding the impact of abrasive particles and the like on said inner wall for engaging workpieces and causing said workpieces to turn over when said barrel is caused to rotate, said cleat means including a workpiece engaging face extending lengthwise of said barrel; the improvement comprising said workpiece engaging face extending inwardly of said barrel from said inner wall and sloped at an obtuse angle with respect to said inner wall of said barrel for precluding workpieces from being carried up to the top of said barrel during rotation thereof.

16. An abrasive blast-resistant barrel as defined in claim 15 wherein said workpiece engaging face and a line tangent to said inner wall define an angle in the range between about 115° and 155°.

17. An abrasive blast-resistant barrel as defined in claim 15 further including workpiece pushing means constructed of a wear resistant material for withstanding the impact of abrasive particles and the like disposed on said inner wall for pushing workpieces along the length of said barrel from adjacent said first end toward said second end; said workpiece pushing means including a leading face portion on a side thereof disposed toward said open second end for engaging workpieces and pushing said workpieces toward said open second end and a trailing face portion on a side thereof disposed toward said open first end; said workpiece pushing means forming a spiral flight extending along said inner wall; and said cleat means being disposed on said inner wall between adjacent spirals of said spiral flight.

18. An abrasive blast-resistant barrel as defined in claim 17 wherein said cleat means is of sufficient length to extend substantially completely between said adjacent spirals of said spiral flight.

* * * * *